US006055806A

United States Patent [19]

Dalton

[11] Patent Number: 6,055,806

[45] Date of Patent: May 2, 2000

[54] EXHAUST MANIFOLD SEALS TO ELIMINATE OIL SLOBBER

[75] Inventor: Dale A. Dalton, Metamora, Ill.

[73] Assignee: Caterpillar Inc., Peoria, Ill.

[21] Appl. No.: 09/074,753

[22] Filed: May 8, 1998

[51] Int. Cl.[7] ..... F01N 1/00

[52] U.S. Cl. ..... 60/272; 60/323; 123/193.5; 277/591

[58] Field of Search ..... 60/272, 323; 123/193.5; 277/591, 610

[56] References Cited

U.S. PATENT DOCUMENTS

| | | | |
|---|---|---|---|
| 3,898,802 | 8/1975 | Tadokoro et al. . | |
| 3,898,803 | 8/1975 | Sasaki et al. . | |
| 4,151,716 | 5/1979 | Sakurai et al. . | |
| 4,604,779 | 8/1986 | Narita et al. | 60/272 |
| 4,629,199 | 12/1986 | Yamamoto et al. . | |
| 4,715,178 | 12/1987 | Tsukuda et al. | 60/272 |
| 5,065,493 | 11/1991 | Ozora . | |
| 5,082,296 | 1/1992 | Aizawa et al. . | |
| 5,135,240 | 8/1992 | Dodson . | |
| 5,308,090 | 5/1994 | Hamada et al. . | |
| 5,414,993 | 5/1995 | Kon | 60/272 |
| 5,454,604 | 10/1995 | Yahagi et al. . | |
| 5,593,745 | 1/1997 | Haselkorn et al. | 60/272 |
| 5,842,342 | 12/1998 | Strasser et al. | 60/282 |

*Primary Examiner*—Thomas E. Denion
*Assistant Examiner*—Binh Tran
*Attorney, Agent, or Firm*—Fred J. Baehr

[57] ABSTRACT

An exhaust manifold seal arrangement to eliminate oil slobber comprises a counter bore in cylinder head exhaust ducts, a spiral wound gasket with chevron shaped ends and a barrel shaped portion disposed between the chevron shaped ends being disposed in the counter bore to form a leak proof seal between the cylinder head and the exhaust manifold and a thermal liner between the exhaust gases and the counter bore, the exhaust manifold being made in three parts with a spiral wound gasket being disposed between the parts to form a leak proof seal between the parts.

10 Claims, 3 Drawing Sheets

EXHAUST MANIFOLD SEALS TO ELIMINATE OIL SLOBBER

TECHNICAL FIELD

The invention relates to a seal and more particularly to a chevron shaped seal between the exhaust manifold and the engine block of an internal combustion engine.

BACKGROUND ART

When the diesel engines operate under light loads, the cylinder pressure is too low under the lightly loaded conditions for the piston rings to form a good seal and keep the oil out of the cylinders. The oil is discharged from the cylinders with the products of combustion. Without a good seal at the joints in the exhaust manifold system this slobbering oil will drip on the engine and it is difficult to determine the origin of the oil. Whether it is the oil slobber leaking from the exhaust manifold or oil leaking from other oil lines. U.S. Pat. No. 5,414,993 describes a liner in the exhaust port to insulate the exhaust gases from the cylinder head and a gasket placed between the flange of the exhaust manifold and the cylinder head.

DISCLOSURE OF THE INVENTION

Among the objects of this invention may be noted the provision of a gasket and liner in the exhaust duct in the cylinder which will form a very reliable seal at start up and when the engine is hot.

In general, an exhaust manifold seal arrangement for an internal combustion engine that has a cylinder block with a plurality of cylinders, and a cylinder head cooperatively associated with the cylinder block. The cylinder head has an exhaust valve and an exhaust duct for each cylinder disposed in fluid communication with an exhaust manifold. The exhaust manifold seal arrangement, when made in accordance with this invention, comprises counter bore in the exhaust ducts extending inwardly from a juncture of the exhaust manifold and the cylinder head and terminating with a flat annular surface disposed perpendicular to the counter bore. A spiral wound gaskets having chevron shaped end portions separated by a barrel shaped portion. The overall length of the spiral wound gasket is greater than the distance between the flat annular surface at the end of the counter bore and the exhaust manifold and the barrel shaped portion does not contact the counter bore. Whereby the spiral wound gasket forms a leak proof seal and a thermal liner between the exhaust gases and the counter bored portion of the exhaust duct.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
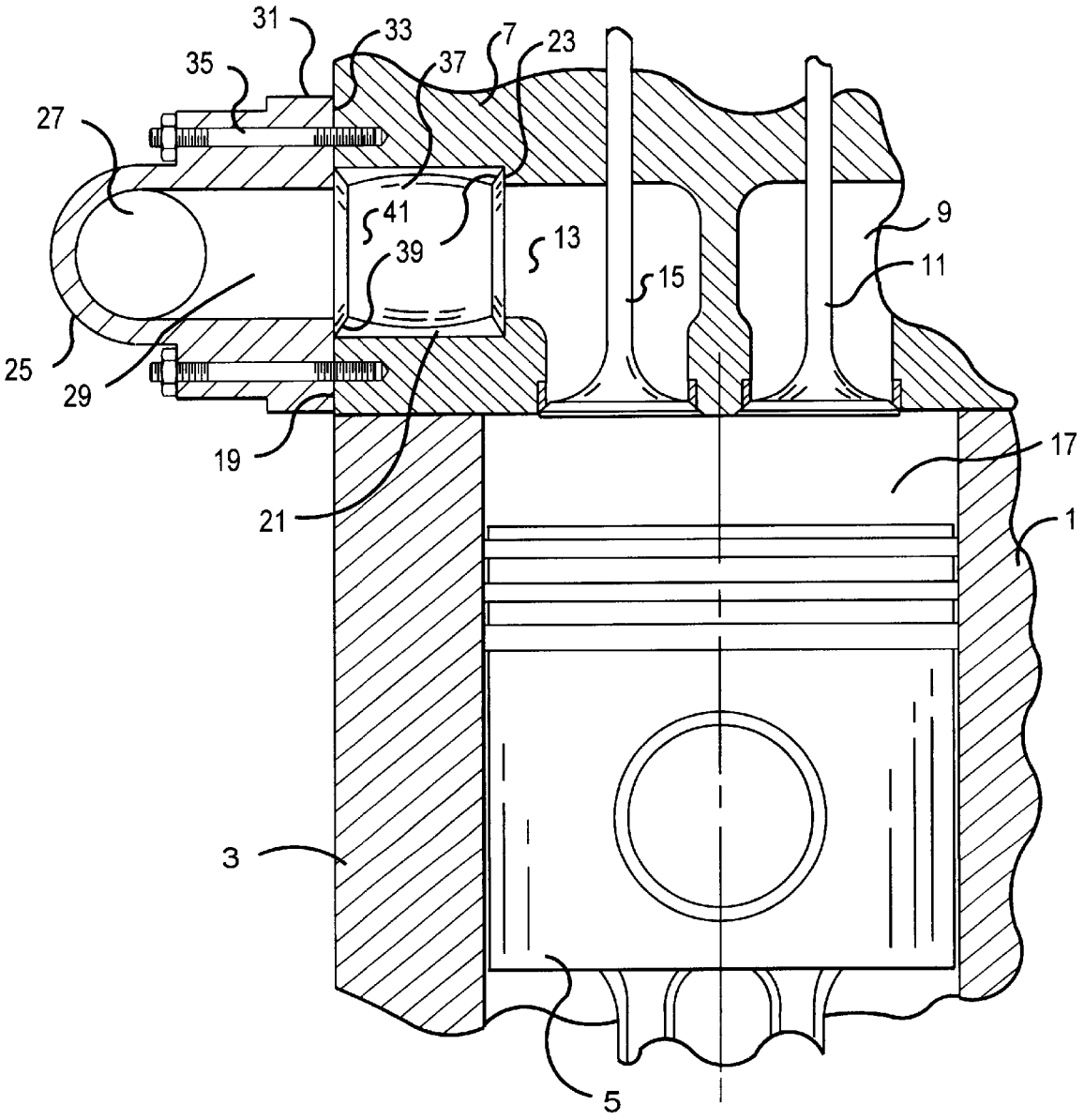
FIG. 1 is a partial section view of a diesel engine showing an exhaust manifold sealing arrangement made in accordance with this invention

Referring now to the drawings in detail and in particular to FIG. 1, there is shown a portion of an internal combustion engine, such as a diesel engine 1, comprising a block 3. The block 3 is bored to receive a plurality of pistons 5 (only one is shown). A cylinder head 7 is disposed above the block 3 only a portion thereof is shown. The cylinder head 7 has an intake duct 9 and valve 11 and an exhaust duct 13 and valve 15 for each piston 5 and cooperates therewith to form a cylinder 17. The exhaust ducts 13 extend from the exhaust valve 15 to a machined flat surface 19 on one side of the cylinder head 7. The exhaust ducts 13 are counter bored so that a counter bore 21 extends inwardly from the flat surface 19 and terminates at an annular flat surface 23 disposed in the counter bore 21 perpendicular to the counter bored surface 21 and parallel to the flat surface 19. An exhaust manifold 25 comprises an elongated header 27 and a plurality of short branch ducts 29, which register with the exhaust ducts 13 in the cylinder head 7. The diameter of opening in the branch ducts 29 is generally equal to the diameter of the exhaust ducts 13 prior to being counter bored. Each branch duct 29 has a flange 31 with a machined flat surface 33, which abuts the flat surface 19 on the cylinder head 7 when the exhaust manifold 25 is fastened to the cylinder head 7 by studs 35 or other fastening means. Disposed in the counter bore 21 is a spiral wound gasket 37 having a generally chevron shaped portion 39 on each end and a generally elongated barrel shaped portion 41 between the chevron shaped end portions 39. The chevron and barrel shaped portions 39 and 41, respectively, cooperate to allow for a sufficient amount of initial compression of the spiral wound gasket 37 between the flat surface 33 on the flange 31 of the exhaust manifold 25 and the annular flat surface 23 in the counter bore 21 to form a leak proof seal, when the manifold flange 31 makes metal to metal contact with the flat surface 19 on the cylinder head 7. The elongated barrel shaped portion 41 allows for thermal expansion of the spiral wound gasket 37 as it is heated by the exhaust gases and also provides a leak proof seal, when the engine 1 has cooled to ambient temperature at start up. The outer most diameter of the barrel shaped portion 41 is smaller than the inner diameter of the counter bore 21 when the spiral wound gasket 37 is compressed and thermally expanded forming a thermal liner reducing the heat transfer from the exhaust gases to the cylinder head 7.

Figure 2:
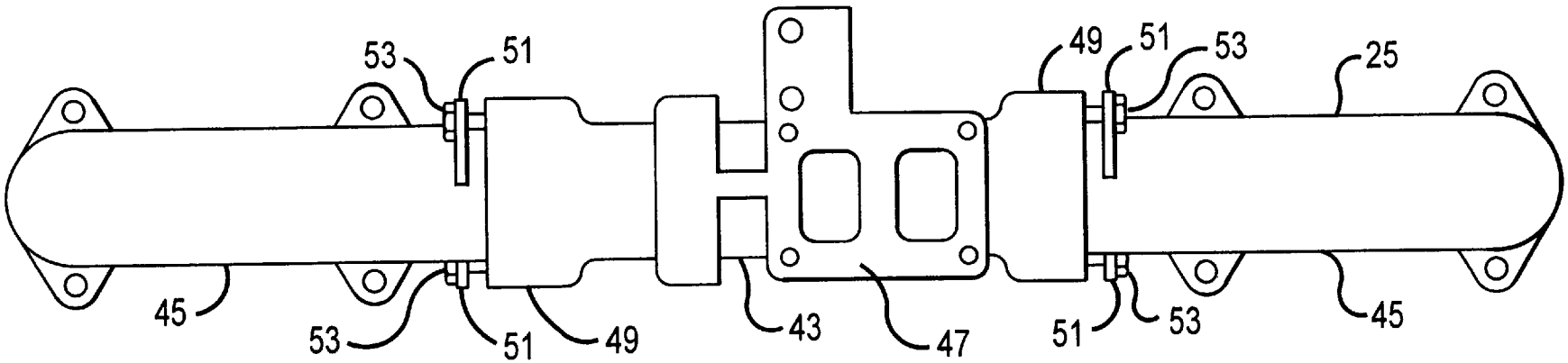
FIG. 2 is an enlarged elevational view of an exhaust manifold.

Referring now to FIG. 2 there is shown the exhaust manifold 25 in more detail. The exhaust manifold 25 is preferably made of three separate portions, a central or center portion 43 and a pair of duplicate end portions 45. The center portion 43 has two branch ducts 29 and a mounting platform 47 for a turbocharger (not shown). The center portion 43 also has an enlarged portion 49 on each end, which is counter bored to receive the end portions 45. The end portions 45 have two branch ducts 29. They may have a single branch duct 29, if the engine 1 has 4 cylinders 17. While 6 and 4 inline cylinders are described it is understood the invention is applicable to an engine with any number of cylinders. The end portions 45 are shown to have two tabs 51 and bolts 53 to compress a chevron shaped spiral wound gasket 55 disposed therein and to fasten the end portions 45 to the center portion 43. A jig could be utilized to hold the end portions 45 to the center portion 43 and compress the gasket 57 until the assembled manifold 25 is fastened to the cylinder head 17 with studs 35, after which the jig could be removed.

Figure 3:
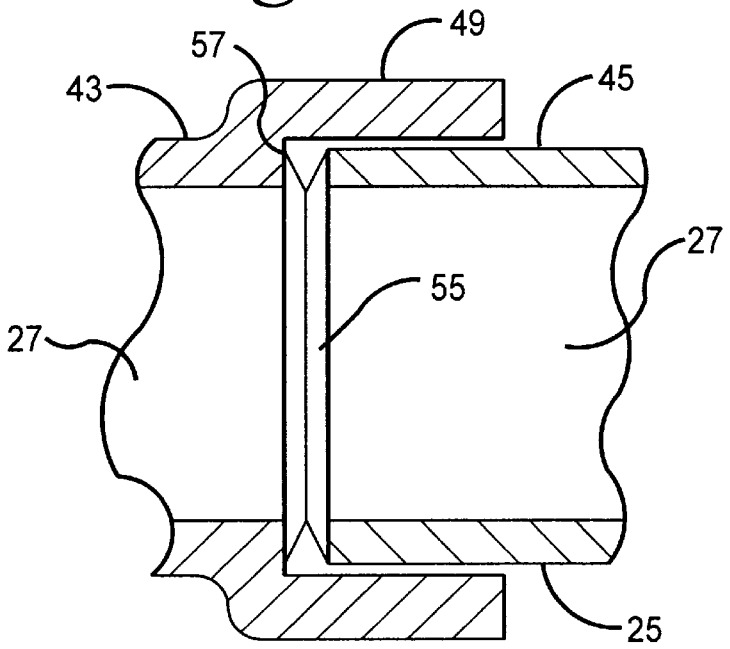
FIG. 3 is an enlarged partial sectional view of a seal between portions of the manifold.

Referring now to FIG. 3 the counter bore in the enlarged portion 49 of the central portion 43 of the exhaust manifold 25 has a flat bottom portion 57. The spiral wound chevron shaped gasket 55 is disposed between the between the flat bottom 57 of the counter bore and the end portions 45 of the exhaust manifold 25 and is compressed to form a leak proof seal.

Figure 4:
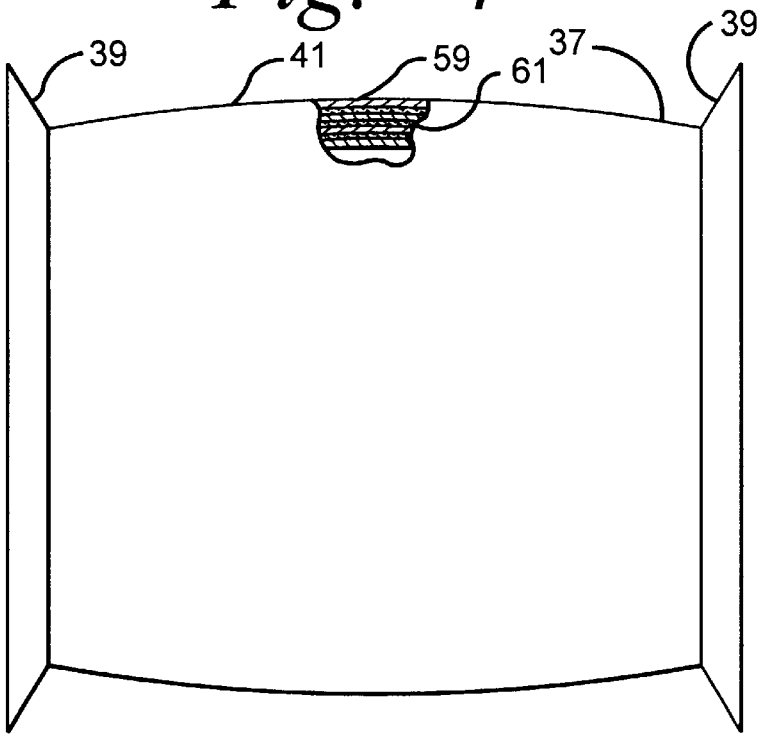
FIG. 4 is an enlarged elevational view partially in section showing the seal in FIG. 1.

FIG. 4 shows that the spiral wound gasket 37 disposed in the counter bore 21 of the exhaust duct 13 has chevron shaped ends 39 separated by a an elongated barrel shaped portion 41. A thin strip of steel 59 is spiral wound with a high temperature resilient carbon or ceramic filler material 61 disposed between the steel layers 59. The edges of the steel strip 59 are fastened down by some type of weld.

Figure 5:
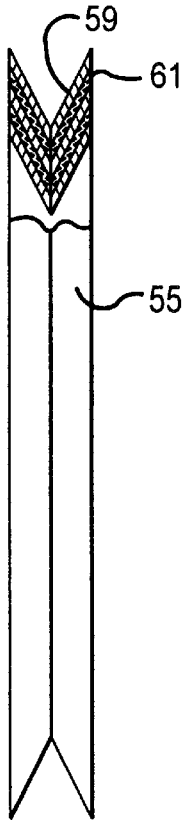
FIG. 5 is an enlarged elevational view partially in section showing the seal in FIG. 3.

FIG. 5 shows the chevron shaped spiral wound gasket 55 is a typical spiral wound gasket commonly used in the industry.

While the preferred embodiments described herein set forth the best mode to practice this invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

Industrial Applicability

An exhaust manifold seal arrangement, when made in accordance with this invention, advantageously provides an exhaust manifold with an improves sealing arrangement that does not leak oil on the engine, eliminating fire risk due to engine lubricating oil from the exhaust manifold igniting outside the manifold. It provides explosion and flame proof joints required by coal and other underground mine applications regulated by the Mining Safety and Health Administration or other mining regulatory agencies. It also allows the piston ring designers to design the piston rings for high loads and pressure as this exhaust manifold sealing arrangement prevents oil passing the piston rings at light loads from leaking from the exhaust manifold. These seals could also be used on the intake manifold to meet the explosion and flame proof joint requirements of underground mining regulatory agencies.

What is claimed is:

1. An exhaust manifold seal arrangement for an internal combustion engine having a block with a plurality of cylinders, a cylinder head cooperatively associated with the block, the cylinder head having an exhaust valve and an exhaust duct for each cylinder in fluid communication with an exhaust manifold, the exhaust manifold seal arrangement comprising a counter bore in the exhaust ducts extending inwardly from a juncture of the exhaust manifold and the cylinder head and terminating with a flat annular surface disposed perpendicular to the counter bore, a spiral wound gasket having chevron shaped end portions separated by an elongated portion, and an overall length greater than the distance between the flat annular surface at the end of the counter bore and the exhaust manifold and the elongated portion does not contact the counter bore, whereby when the exhaust manifold is fastened to the cylinder head, the spiral wound gasket forms a leak proof seal and a thermal liner between the exhaust gases and the counter bored portion of the exhaust duct.

2. The exhaust manifold seal arrangement as set forth in claim 1, wherein the spiral wound gasket is formed of spiral wound steel with a high temperature resistant material disposed between the spiral windings.

3. The exhaust manifold seal arrangement as set forth in claim 2, wherein the elongated portion is a barrel shaped portion between the chevron shaped portions, the chevron and barrel shaped portions and cooperating to allow for a sufficient amount of initial compression of the spiral wound gasket to form a leak proof seal between the flat annular surface at the end of the counter bore and the exhaust manifold, to allow for thermal expansion as the spiral wound gasket is heated by the hot exhaust gases and to form a leak proof seal when the engine is cooled down to ambient temperature at start up.

4. The exhaust manifold seal arrangement as set forth in claim 3, wherein the chevron shaped and barrel shaped portions are formed to prevent the barrel shaped portion from contacting the counter bore portion of the exhaust duct in the cylinder head providing a thermal liner to reduce heat transfer from the exhaust gases to the cylinder head.

5. The exhaust manifold seal arrangement as set forth in claim 4, wherein the exhaust manifold has a header and a plurality of branch ducts that register with the exhaust ducts in the cylinder head and a central portion and an end portion on each end of the central portion, the central portion having an enlarged portion on each end counter bored to receive the end portions, a spiral wound gasket is disposed in the counter bored ends of the central portion and is compressed to form a leak proof seal between the central and end portions and of the exhaust manifold.

6. The exhaust manifold seal arrangement as set forth in claim 5, wherein each branch duct has a flange portion which is fastened to the cylinder head.

7. The exhaust manifold seal arrangement as set forth in claim 6, wherein the end portions of the exhaust manifold each have two branch ducts.

8. The exhaust manifold seal arrangement as set forth in claim 7, wherein the spiral wound gasket between the central and two end portions of the exhaust manifold is chevron shaped.

9. The exhaust manifold seal arrangement as set forth in claim 8, wherein the central portion of the exhaust manifold has two branch ducts.

10. The exhaust manifold seal arrangement as set forth in claim 9, wherein the central portion of the exhaust manifold has a platform for mounting a turbocharger.

* * * * *